US005368158A

United States Patent [19]

Miaud

[11] Patent Number: 5,368,158

[45] Date of Patent: Nov. 29, 1994

[54] INDIVIDUAL DECONTAMINATION APPARATUS

[75] Inventor: Pierre Miaud, Charenton-le-Pont, France

[73] Assignee: Gallet S. A., Chatillon-sur Chalaronne, France

[21] Appl. No.: 75,544

[22] PCT Filed: Jan. 7, 1992

[86] PCT No.: PCT/FR92/00010

§ 371 Date: Jun. 11, 1993

§ 102(e) Date: Jun. 11, 1993

[87] PCT Pub. No.: WO92/11795

PCT Pub. Date: Jul. 23, 1992

[30] Foreign Application Priority Data

Jan. 7, 1991 [FR] France ..... 91 00107

[51] Int. Cl.[5] ..... B65D 81/32; B65D 85/00

[52] U.S. Cl. ..... 206/222; 206/229; 206/223; 206/278

[58] Field of Search ..... 206/209, 219, 222, 223, 206/229, 278, 361, 484, 581, 568

[56] References Cited

U.S. PATENT DOCUMENTS

| | | | |
|---|---|---|---|
| 3,561,456 | 2/1971 | Stuart, Jr. | 206/229 |
| 4,516,676 | 5/1985 | Cournoyer | 206/229 |
| 4,901,851 | 2/1990 | Gerry . | |
| 4,917,238 | 4/1990 | Schumacher | 206/223 |
| 4,946,033 | 8/1990 | Conner | 206/223 |
| 5,035,321 | 7/1991 | Denton | 206/229 |
| 5,058,738 | 10/1991 | Svensson | 206/229 |
| 5,083,337 | 1/1992 | Jones | 206/223 |
| 5,111,934 | 5/1992 | Morin | 206/229 |

FOREIGN PATENT DOCUMENTS

| | | | |
|---|---|---|---|
| 0225621A3 | 6/1987 | European Pat. Off. . | |
| 2079975 | 11/1971 | France . | |
| 3027644 | 7/1980 | Germany . | |
| 0657590 | 9/1951 | United Kingdom | 206/229 |
| 2221389 | 2/1990 | United Kingdom | 206/229 |

*Primary Examiner*—Jimmy G. Foster

*Attorney, Agent, or Firm*—Herbert Dubno; Andrew Wilford

[57] ABSTRACT

A decontamination kit for military use has a hermetically sealed package of a material generally impermeable to toxic agents containing an absorbent mitten capable of absorbing toxic agents, a towel, and a device for making an active decontaminant liquid applicable to the towel. Thus the object to be decontaminated is first cleaned with the mitten, then the decontaminant liquid is made up and applied to the towel, and the towel is used in a second stage for a fine cleanup.

13 Claims, 4 Drawing Sheets

INDIVIDUAL DECONTAMINATION APPARATUS

FIELD OF THE INVENTION

The invention relates to an apparatus for individual decontamination, mainly for military use.

BACKGROUND OF THE INVENTION

The decontamination glove of the French army which is part of the individual soldier's equipment and whose active element is constituted by an absorbing powder of diatomic earth, fuller's earth, or other cleaning clay, has three main disadvantages:

The first is the fact that its use (done by patting with the glove on any contaminated clothing surface) inherently forms around the soldier a cloud of powder full of the toxic agent that it has absorbed and that can be carried away by wind or a simple breeze relatively long distances where it can contaminate clean locations.

The second is that is that its use for decontaminating a gas mask as well as the other equipment of the soldier, in particular his rifle, is not very reliable. In effect on the one hand access to certain contaminated surfaces is difficult if not impossible because of the shape of the glove (lack of suppleness because it is too thick) and on the other hand there is not only the possibility of scratching transparent surfaces (visor or eye-pieces) but also the risk of depositing the earth impregnated with the toxic agent in the screwthreads and other cavities where it can be held.

Finally, the third disadvantage, which is not the least, is that a powder, whatever it be made of, not only does not destroy the toxic agent that it absorbs but can also under certain circumstances release it which then presents a certain danger to the environment.

The term "decontamination" glove for this type of product is therefore an incorrect name in the sense that it designates a function that it does not completely fulfill.

OBJECT OF THE INVENTION

It is therefore an object of the present invention to provide an improved decontamination kit or apparatus particularly suitable for military use.

The present invention, which palliates these cited disadvantages, relates to a decontamination apparatus based on a different concept. This apparatus permits in effect:

in a first step, absorbing without polluting the major part of the toxic agent fixed on the clothing, the mask, and the equipment without subsequently releasing it, in a second step, chemically destroying the unabsorbed toxic agent on the clothing, on the mask (without the risk of scratching its transparent parts), as well as on the equipment (without the risk of leaving a deposit inside spaces where it is possible to trap the toxic agent).

To this end the main object of the invention is an individual decontamination apparatus which includes inside a common package and/or case both an absorbent mitten-type glove and a separate wiping towel that can be impregnated with an active decontaminant made in situ when needed. Preferably the apparatus according to the present invention comprises in the same package and/or case a device serving for the preparation in situ of the active decontaminant provided for impregnating the wiping towel.

Preferably the individual decontamination apparatus is to start with isolated from the ambient atmosphere by a flexible protective package formed of a synthetic-resin film that is impermeable to toxic agents. The flexible package, provided with means facilitating opening it, preferably encloses a case of semirigid material and parallepipedal shape formed by two hollow case parts interconnected by a spring hinge; the case thus opens like a book but lengthwise and the spring hinge holds it open while in use. A fixed bar disposed along an edge opposite the spring hinge is usefully provided for maintaining the two case parts stuck together such that the case remains closed before use of the apparatus.

According to a preferred embodiment, the two case parts each have around their edges a seal strip intended to receive a peelable cover film ensuring perfect sealing with respect to the exterior of the internal spaces of the two case parts. The interior of one of the two case parts holds the absorbent glove and the device serving for the in situ preparation of the active decontaminant while the interior of the other case part contains the wiping towel.

The device integrated into the apparatus and serving for the in situ preparation of the active decontaminant provided for impregnating the wiping towel is preferable constituted as a device for separately holding two components and combining them when used, mainly for making a decontaminant solution by mixing the two stored components, one a solid and the other a liquid. This device can in particular be the one described in French patent application 90 08870/2,664,570 (see also international application PCT/FR91/00577). The solution obtained by mixing the two stored components in such a device is spread on the towel which is already impregnated with a liquor holding in solution other components of the decontaminant. This idea allows one to make at the time of use a product which, while without long-term stability, is of maximal decontaminant effectiveness.

The glove allows one to eliminate the large part of the toxic agent by absorption, this glove being formed of a material which does not release the toxic agent after absorption and does not spread any powder into the environs even when patted strongly on clothes. The towel makes it possible to eliminate the remnants of the toxic agent by destruction of their molecules. Thus the combination of physical and chemical effects, thanks to the combined action of the glove and of the towel, leads to an efficient elimination of the toxic agent, the device for the in situ preparation of the active decontaminant allowing one to benefit from its maximum effectiveness.

The decontamination apparatus according to the invention can be put into use rapidly, in about 3 min and the actual decontamination operation can be done very carefully in about 15 min and it is intended to be destroyed after use. Of simple conception, this apparatus can be easily kept, for example, in one of the side pockets of a bag containing the gas mask of the soldier.

BRIEF DESCRIPTION OF THE DRAWING

The invention will be better understood and other characteristics will be more apparent, with the help of the following description, referring to the attached schematic drawing showing by way of non-limiting example an embodiment of the individual decontamination apparatus.

DESCRIPTION

Figure 1:
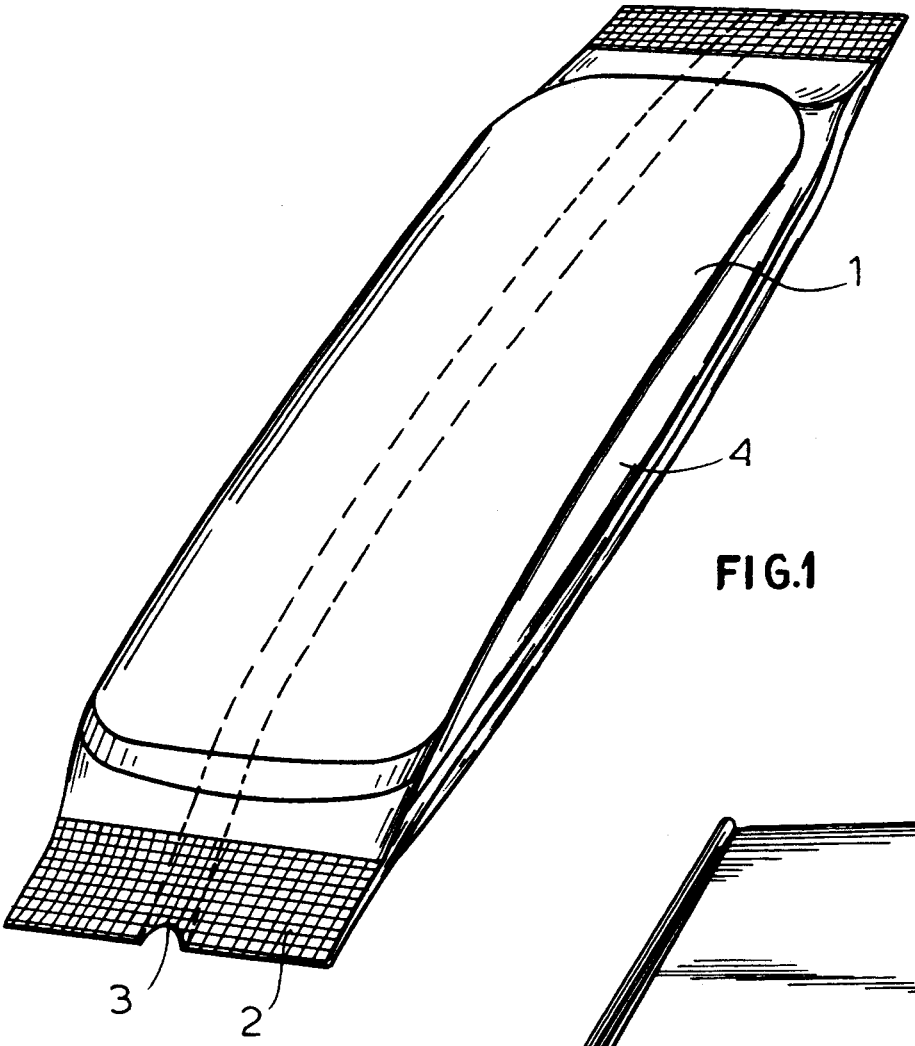
FIG. 1 shows in perspective the apparatus in its package that is impermeable to toxic agents.
Figure 2:
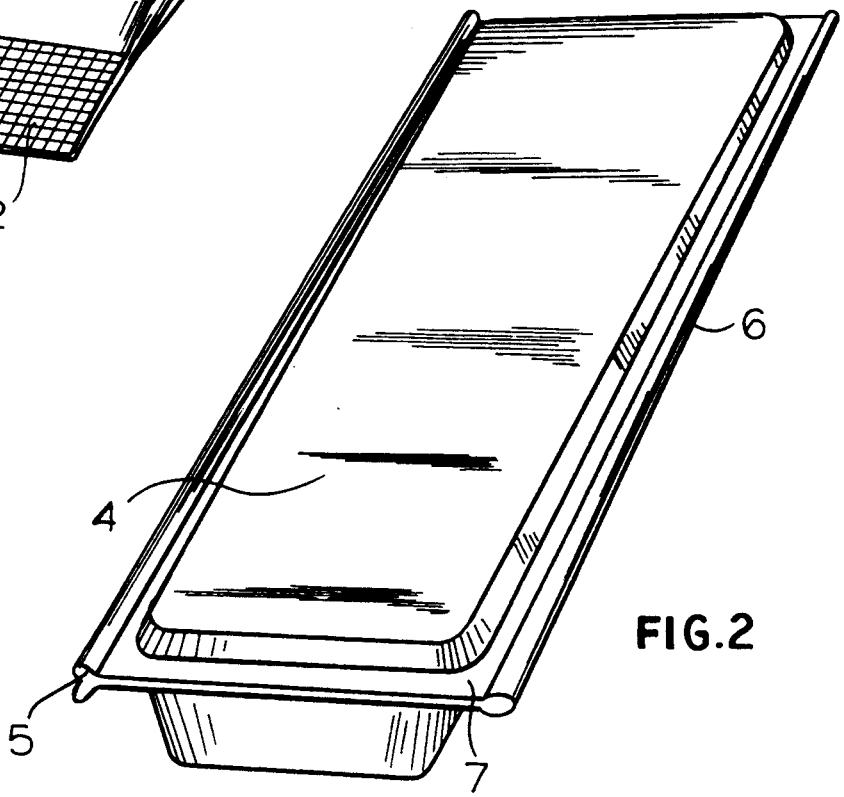
FIG. 2 shows the apparatus still in perspective but outside its package.

With reference to the drawing, first of all to FIGS. 1 and 2, the structure of the individual decontamination apparatus comprises according to a particular embodiment:

A flexible package 1 in synthetic-resin film that is impermeable to toxic agents. By way of nonlimiting example the main film is a saturated polyester with a special face laminated with transparent polyethylene. This package which is formed according to the flow-pack method has the particularity of having one of its ends bonded along a length (4 to 5 cm) such that it forms a tongue 2 that the soldier uses as a gripping handle for easily pulling the apparatus out of the side pocket of a bag which can also contain a gas mask. The tongue 2 has a tear notch 3 serving for easy opening of the package 1 and extraction of a case 4.

A case 4 which is of parallepipedal shape. By way of nonlimiting example it is formed of a semirigid material, PVC 0.80 mm thick, laminated with polyethylene on its inside face. It is formed by two case parts of unequal depths which are hinged together at a spring hinge 6 over an angle of 180°. A closing bar 6 fitted along the edge opposite the hinge 5 straddling the seal strips 7 holds the two case parts face-to-face stuck one against the other so long as the case 4 is closed when stored before use. When the closing bar 6 is removed the case 4 opens by itself thanks to the spring hinge 5; the two case parts then form an angle of about 180°.

Figure 3:
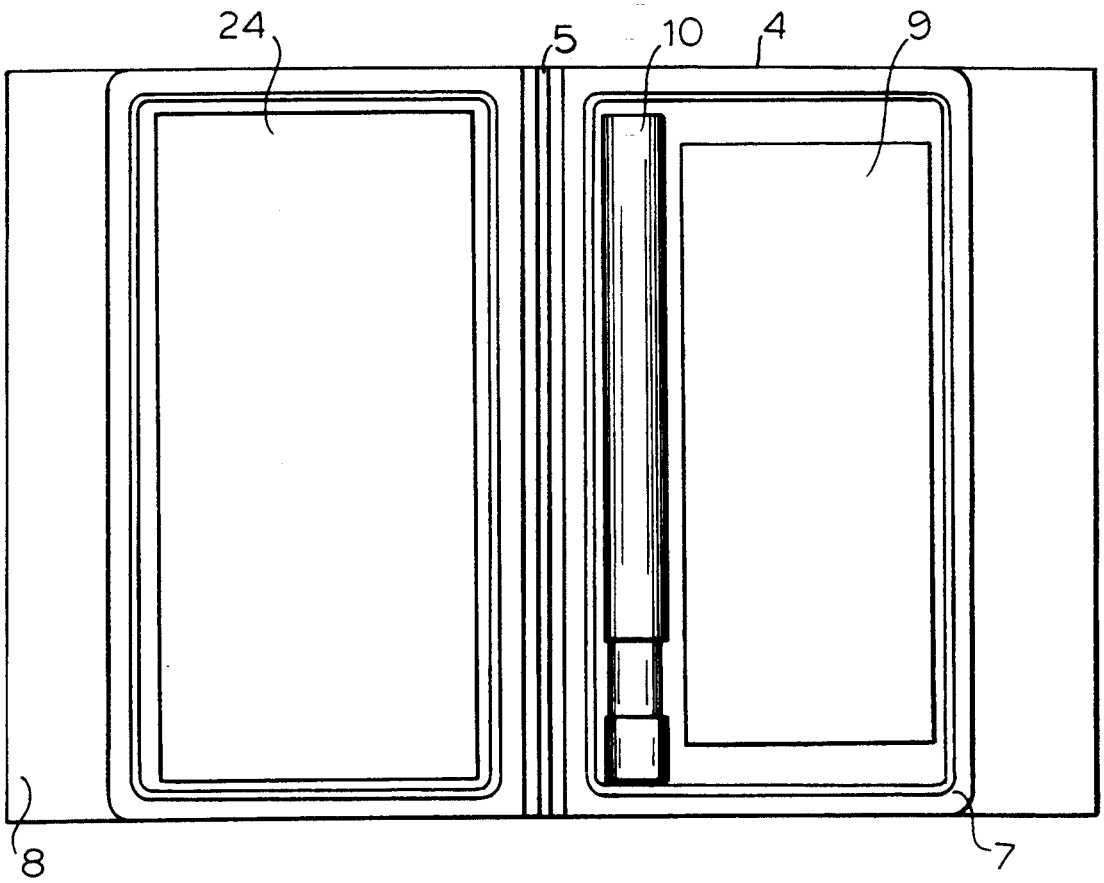
FIG. 3 shows the apparatus with case open, seen in plan from above.

FIG. 3 shows the top plan view of the open case 4. One can see the presence of a transparent peelable film 8 which to start with closes the two case parts in a completely hermetic manner. This sealing is obtained by a thermal weld about 5 mm wide of the film 8 along the seal strip 7. The side edges of the film 8 which are some 4 cm to 5 cm wide and which are folded inside when the case 4 is closed, make it easy to grasp the film 8 when removing it.

Figure 6A:
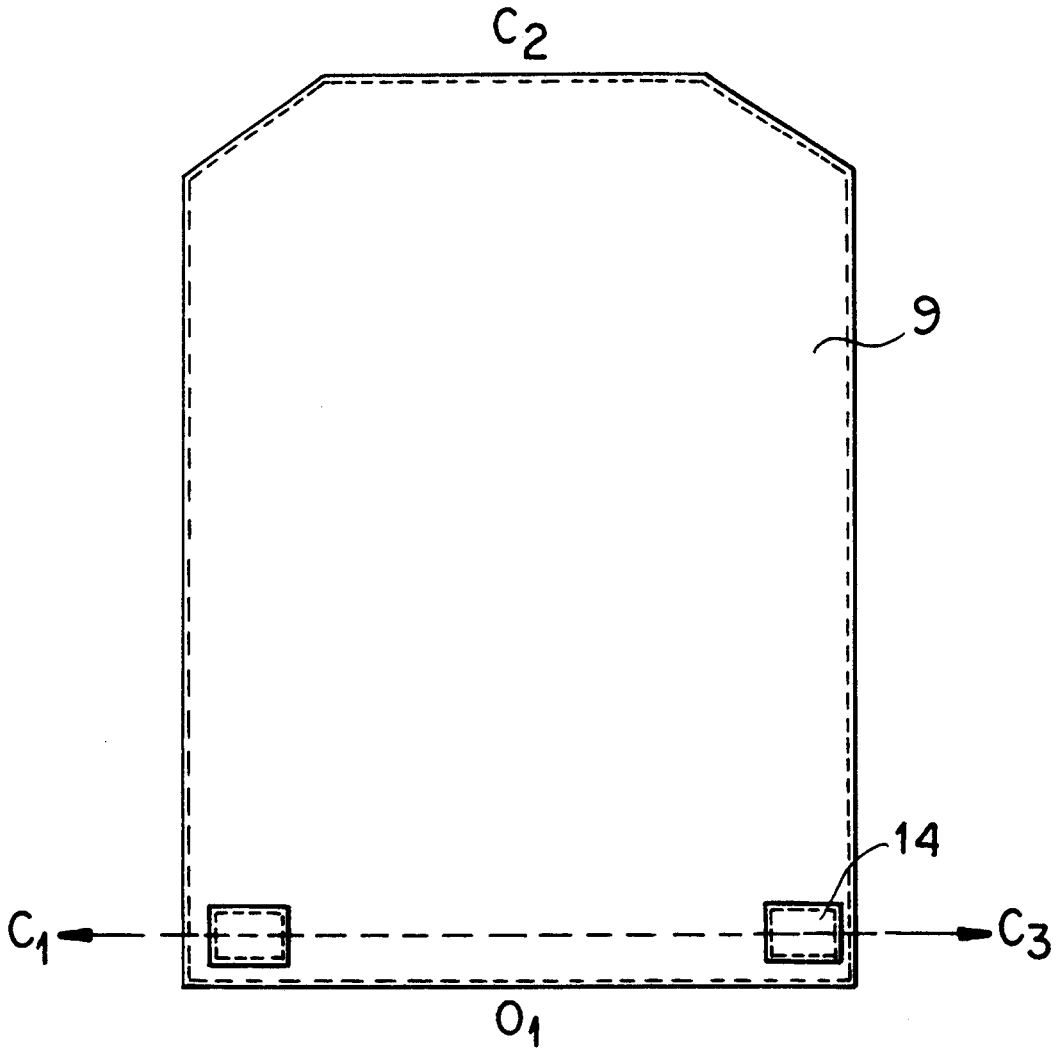
FIG. 6A is a front view of the absorbent glove.
Figure 6B:
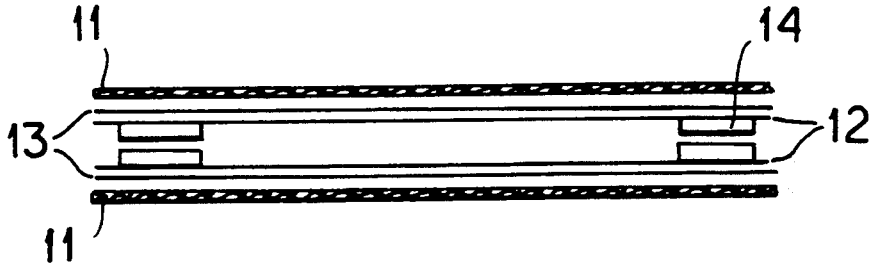
FIG. 6B is a cross sectional view through the glove.

A first case part holds on one side a glove 9 and on the other side a device 10 for separately storing two components and combining them for use. The mitten-type glove is shown in FIG. 6A in plan view and in section in FIG. 6B. This glove 9 is essentially formed by a fabric 11 of carbon-foam base used to make NBC protective clothing. The exterior (nylon and cotton) layers are always adapted to satisfy inherent technological constraints, in particular the mechanical stresses it is subjected to during the decontamination operation (resistance to tearing as well as rubbing).

The hand (gloved or not) is protected inside by a barrier material 12 formed by a synthetic-resin film that is impermeable to toxic agents, such as an unsaturated polyamide/polyester complex.

In a particular embodiment an absorbent layer 13 of polypropylene and a mat of the Meltblown type is interposed between the carbon-foam fabric 11 and the barrier material 12.

The different thicknesses of the materials (carbon-foam fabric, absorbent Meltblown layer, barrier material) are interconnected by stitching along edges $C_1$, $C_2$, and $C_3$. The open end $O_1$ through which the hand is inserted into the glove 9 has a two-layer cuff.

Two closures with autogripping strips 14 secure the end of the glove 9 on the hand of the user.

The device 10 for separately storing two components and combining them for use is one of the essential parts of the apparatus. It in effect allows one to make a decontaminant solution which degrades rapidly with time, that is which very rapidly loses its specific activity so that it must be used as soon as it is made up. This is a very well known phenomenon that is known with the use of hypochlorites for example.

The device 10 contains two reservoir tubes each closed at one end; the first male reservoir tube containing one of the components extends into the second female tube that contains the other component. A very thin membrane extending perpendicular to the axis of the female tube perfectly seals between the two components.

Activation, that is connecting together the two reservoirs which results in contacting the two components, is effected by pushing together the male and female tubes. The end of the male tube, which is angled according to a particular embodiment, punctures the membrane and holds it in a position such that the two reservoirs communicate totally. During this operation external and internal pressures are balanced through a very small-diameter orifice in a wall of the male part. The male part, which serves as a stopper for the female tube, is then separated from the latter to recover the solution that can be poured.

Figure 8:
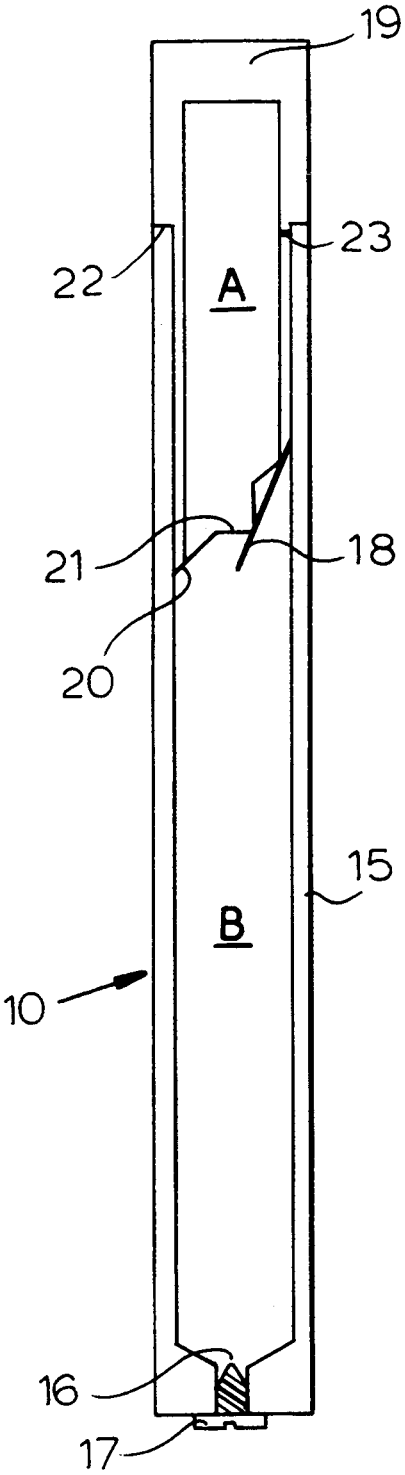
FIGS. 7 and 8 show in two positions the device for separately storing two components and combining them for use.
Figure 7:
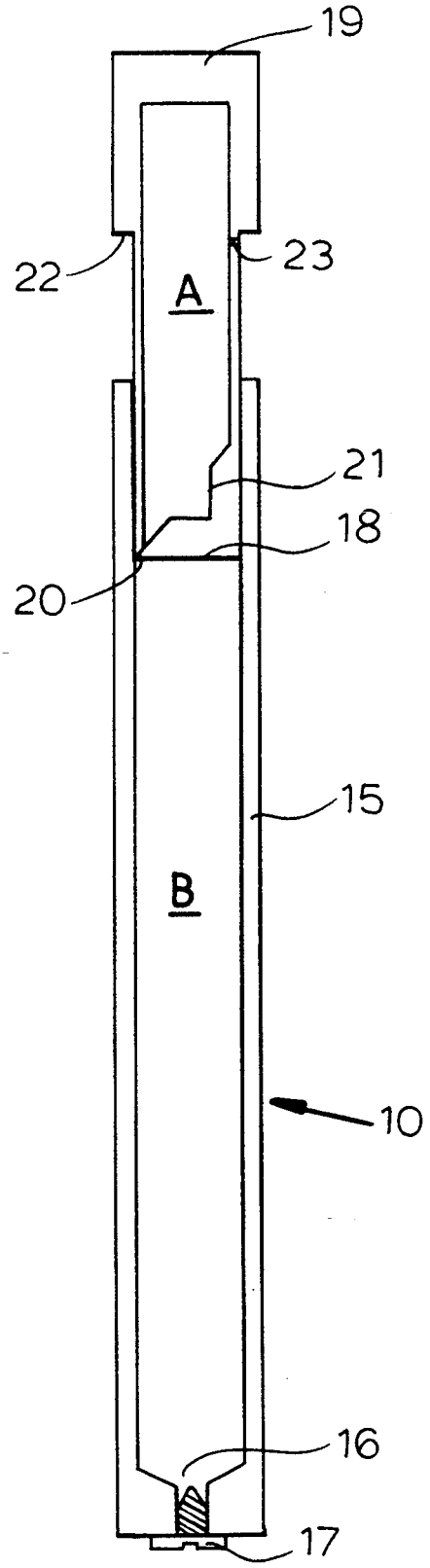

FIG. 7 shows a particular embodiment of the device in section before activation (thus when stored) and FIG. 8 shows the same device after activation.

With reference to these figures, the device comprises:

A circular-section female tube 15 closed at one end which has a hole 16 closed by a removable closure 17. A very thin membrane 18 (about 0.2 mm thick) particularly when the device is made of plastic is set at a predetermined distance from the mouth of the tube 15.

A male tube 19 which is engaged in the female tube 15, its open end 20 juxtaposed with the membrane 18. This end is cut at an angle in a certain way to have a stepped edge 21. The closed end of the male tube 19 has a shoulder 22 which serves as a stop for the female tube 15 when the two tubes are pushed together. A pressure-equalizing orifice 23 of 0.1 mm diameter is formed perpendicular to the axis at a distance from the shoulder 22 which is set as a function of the dimensions of the assembly.

The reservoir A of the male tube 19 is filled through the orifice of this tube which is maintained upright; the reservoir B of the female tube 15, also upright, is filled through the orifice 16 which is subsequently plugged by means of the closure 17. Then the two tubes 15 and 19 are fitted together, the membrane 18 serving as a stop in the rest position of the angled end of the male tube 19.

By way of nonlimiting example, the dimensions of the device 10 in rest position are 20 mm total length, 2 cm external diameter, and the reservoirs A and B are respectively of 7 $cm^3$ and 25 $cm^3$ capacity.

By way of nonlimiting example, in this device the two separately stored components in the respective reservoirs A and B which are combined when used are respectively water and sodium dichloroisocyanurate. The in situ mixing of the aqueous solution of sodium dichloroisocyanurate and of the alkaline solution of sodium borate (impregnating the decontamination towel) forms an active decontaminant capable of breaking the molecules of most toxic chemicals.

Figure 4:
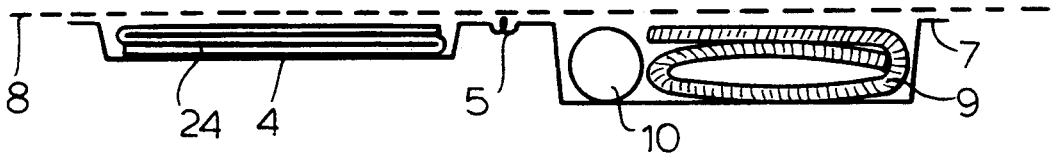
FIGS. 4 and 5 are sectional views of the apparatus respectively when open and closed.
Figure 5:
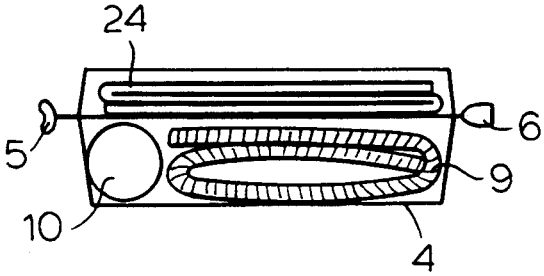

The second case part of the apparatus contains a decontamination towel 24 shown in FIGS. 3 to 5. By way of nonlimiting example, the rectangular towel 24 measures when unfolded 39 cm by 72 cm; it is 0.50 cm thick and is folded over 16 times. In a particular and nonlimiting embodiment, it is formed of an unwoven polypropylene fabric made very hydrophilic by an appropriate treatment. It is impregnated with a solution of highly basic sodium borate and then it is folded and placed in its case part. The later is sealed immediately along with that of the glove 9 and the device 10 for separately storing the two components and mixing them for use.

Use of the apparatus is extremely simple. One proceeds as follows:

The package 1 is torn where indicated by for example a red spot at the tear notch 3;

The closing bar 6 of the case 4 is removed so it opens up like a book thanks to the elasticity of the hinge 5, thus affording access to two case parts sealed by the same plastic film 8;

The two case parts are unsealed by pulling on the edges, which are made for this purpose, of the film 8 which is peelable and which seals in the contents from the exterior atmosphere;

The cylindrical device 10 for storing and combining the two components is removed;

This device 10 is activated and held upright while tapping firmly on its top with the other hand so as to force the tube 19 into the tube 15 and perforate the membrane 18. Then it is sufficient to shake the device 10 for about 2 min so as to dissolve the solid component, to pull off the male tube 19 (the device being returned to the upright position) and to pour its contents into the towel 24 held in its case part while spreading the liquid uniformly over all the surface of the towel and not just on one part of same.

The apparatus is then ready to be used by the soldier in two successive steps:

First step: With his hand in the glove 9 from the first case part, the user presses repeatedly on the entire surface to be decontaminated before going on by wiping this surface (one can turn the glove 9 through 180° on the hand to successively use its two faces). The same procedure is repeated for the mask and equipment.

Second step: The soldier then gets rid of the glove 9 impregnated with the chemical decontaminant and takes from the other case part the towel 24 impregnated with the active decontaminant and unfolds it. He then slowly but very carefully wipes every surface of his mask and of his equipment while being sure that, thanks to the suppleness and to the mechanical resistance of the material forming the towel 24, he reaches into the places where the glove 9 could not enter, and thus goes about rapidly wiping the entire surface of his clothing.

The glove 9, the towel 24, the case 4, and the device 10 for storing and mixing the two components are finally placed in a recipient (flexible bag or the like) to be picked up and destroyed.

The length of the individual decontamination operation as described above can vary according to the person from 10 to 20 min. The uses of this decontamination apparatus are principally military and can relate to ground forces, air forces, and marine forces.

I claim:

1. A decontamination kit comprising:

a hermetically sealed package of a material generally impermeable to toxic agents;

an absorbent mitten in the package capable of absorbing toxic agents;

a towel in the package; and means including a device in the package for making an active decontaminant liquid applicable to the towel.

2. The decontamination kit defined in claim 1 wherein the package includes a flexible sealed bag.

3. The decontamination kit defined in claim 2 wherein in the bag is formed at one end with an extension tongue, whereby the bag can be gripped and pulled from a pocket by means of the tongue.

4. The decontamination kit defined in claim 2 wherein in the bag is formed with a tear notch.

5. The decontamination kit defined in claim 2 wherein the package includes a semirigid case comprised of two hollow case parts, and hinge means interconnecting the parts for relative movement between a closed position lying against and open toward each other and an open position.

6. The decontamination kit defined in claim 5, wherein the package further comprises means including a closing bar engaged along an edge of the case opposite the hinge means for retaining the case in the closed position.

7. The decontamination kit defined in claim 5 wherein the case parts have annularly continuous edge strips, the package further comprising a sealing membrane adhered to the case parts at the strips and enclosing the glove, towel, and device in the case parts.

8. The decontamination kit defined in claim 7 wherein the glove and device are in one of the case parts and the towel is in the other case part.

9. The decontamination kit defined in claim 1 wherein the glove comprises:

an impermeable inner liner, and an outer layer of a carbonize foam.

10. The decontamination kit defined in claim 9 wherein the glove further comprises an absorbent layer between the liner and the outer layer.

11. The decontamination kit defined in claim 1 wherein the towel is made of a hydrophilic polypropylene and is impregnated with a highly basic solution of sodium borate.

12. The decontamination kit defined in claim 1 wherein the device comprises:

a pair of reservoirs each containing a respective component of the active decontaminant, a frangible partition between the reservoirs, and means for rupturing the partition and mixing the components.

13. The decontamination kit defined in claim 12 wherein the components are water and sodium dichloroisocyanurate.

* * * * *